United States Patent [19]

Kiritani et al.

[11] 4,073,625

[45] Feb. 14, 1978

[54] PROCESS FOR PREPARING BRIQUETTES

[75] Inventors: Yoshio Kiritani, Osaka; Michio Tsuyuguchi, Wakayama; Tetsuo Ibaragi, Wakayama; Katsuhiro Yano, Wakayama; Yoshihiko Sunami; Kunihiko Nishioka, both of Amagasaki, all of Japan

[73] Assignee: Sumitomo Metal Industries Limited, Osaka; Sumikin Coke Company Limited, 03, Wakayama, both of Japan

[21] Appl. No.: 728,008

[22] Filed: Sept. 29, 1976

[51] Int. Cl.[2] ..... C10L 5/00; C10L 5/16

[52] U.S. Cl. ..... 44/10 R; 44/10 G; 44/23

[58] Field of Search ..... 44/10 H, 23, 10 I, 10 R, 44/10 G

[56] References Cited

U.S. PATENT DOCUMENTS

| | | | |
|---|---|---|---|
| 1,611,616 | 12/1926 | Tormin | 44/23 |
| 1,647,075 | 10/1927 | Bowen | 44/10 H |
| 2,834,660 | 5/1958 | Eisenhut et al. | 44/23 X |

FOREIGN PATENT DOCUMENTS

| | | | |
|---|---|---|---|
| 508,343 | 6/1939 | United Kingdom | 44/10 G |

*Primary Examiner*—Carl F. Dees

*Attorney, Agent, or Firm*—Watson, Cole, Grindle & Watson

[57] ABSTRACT

A process for preparing a briquette is disclosed. The process comprises a coal with a caking substance having a softening point of 20°–40° C or with a caking substance having a softening point of above 40° C and a solvent which has fluidity at normal temperature and is compatible with the caking substance to a coal for making briquettes, powerfully mixing at a temperature of above 10° C, preferably of 20°–50° C, for 1–10 minutes, by using a mixer provided with a mixing tool which is rotated at a speed of more than 5m/sec. peripheral velocity and/or a mixer provided with a mixing tool which applies a pressure of more than 45kg/cm$^2$; and briquetting by using a roll press, whereby a briquette is obtained having a shutter strength of more than 80 and a trommel strength of more than 90.

12 Claims, No Drawings

PROCESS FOR PREPARING BRIQUETTES

BACKGROUND OF THE INVENTION

1. Field of the Invention

The present invention relates to a process for preparing a briquette from a coal for use in coke production.

2. Description of the Prior Art

Recently, because of the marked development of the iron and steel industry, the demand for coke, which is one the main raw materials for the industry, has been increasing more and greatly. However, a hard coking coal of high grade, which is indispensable for the production of metallurgical (iron manufacturing) cokes, has not only been rising in price due to the scarcity of resources in the world, but also has become difficult even to secure. Therefore, studies have been directed toward processes the manufacture a blast furnace coke of good quality wherein relatively low-grade coals are employed, i.e. non coking coal or poorly coking coal which heretofore have not been regarded as suitable for this purpose, or toward processes where a larger amount of soft cooking coal is blended. In the latter processes there have been proposed various kinds of caking substances and preparation processes using these low grade coals.

Processes for blending briquettes, which is one of techniques for preparing metallurgical cokes, have also been proposed in order to solve the subjects mentioned above. The, the conventional briquette preparation technique is a process wherein a bituminous substance having a softening point of about 60°–80° C is used as a caking substance, mixing is effected by using a low speed rotating type mixer in which its mixing tool operates at a peripheral velocity of lower than 5.0m/sec., such as a pug mill etc., while passing through steam of 120°–250° C, and the heated mixture is briquetted. It is important in this process to regulate the softening point of the caking substance, the temperature of the passing steam and the mixing time. Owing to various restriction the mixing time of about 4–7 minutes has been adopted on an industrial scale. In order to maintain the strength of the briquette from such a process, a caking substance must be properly selected so that it has a softening point corresponding to the temperature of steam and therefore a large amount of steam must be passed. However, if a caking substance having a softening point of above 120° C is used, it may solidify occasionally before briquetting according to the heating conditions, even if steam of above 200° C is passed. Consequently, there has been a strict limitation in the selection of caking substances, and only coal tar pitch having a softening point of 60°–80° C has been used. Moreover, there are many restrictions in installing and constructing a new steam generator for supplying steam due to the strengthening of pollution control regulations, and large expenses are incurred to comply with these regulations.

SUMMARY OF THE INVENTION

As a result of our various studies on the transportation, storage, charging and others of a briquette in a process for coke production, we previously developed a process for preparing a briquette such that the briquette can be transported to and handled in coke production in this process, a caking substance having a lower softening point is used in place of coal tar pitch which has a softening point of 60°–80° C, which is a main conventional caking substance. We thereby succeeded in lowering the steam temperature as well as in enlarging the applicable range of caking substances. As a result of our earnest studies, we have now improved the prior process which in general requires heating, that is we have established a novel process able to be practiced on an industrial scale wherein mixing and briquetting are carried out at a normal temperature in making briquette which is used for the production of blast furnace coke.

An object of the present invention is therefore to provide a process for preparing a briquette wherein the coal for making briquettes is blended with a caking substance, mixed by using a powerful mixer, and then briquetted at normal temperature without passing through a heating medium.

The present invention relates to a process for preparing a briquette comprises blending a caking substance having a softening point of 20°–40° C to coal granules, mixing the granules at a temperature of above 20° C, preferably above 20° C, for 1–10 minutes, preferably for 2–5 minutes, by using a powerful mixer such as high speed rotating type mixer whose mixing tool (including an auxiliary mixing tool) is rotated at a speed of more than 5m/sec. peripheral velocity to the granules and/or an increasing pressure type mixer whose mixing tool applies a pressure of more than 45kg/cm$^2$ to the granules, and briquetting by using a roll press without especial heating.

The present invention further relates to a process for preparing a briquette comprises blending, in place of the above caking substance having a softening point of 20°–40° C, a caking substance having a softening point of above 40° C and a solvent which has fluidity at normal temperature and is compatible with said caking substance with a coal, and then performing the powerful mixing under the above-mentioned mixing conditions according to the present invention and briquetting without especial heating.

DETAILED DESCRIPTION OF THE INVENTION

According to the present invention, not only can various bituminous sbustances having a softening point of above 20° C be used as caking substances, but also the mixing and briquetting steps can be performed at normal temperature of 10°–50° C and a heating medium such as steam is almost unnecessary. In the conventional art for briquette preparation, steam having a temperature higher than the softening point of the caking substance is passed into the mixer to plasticize the caking substance, the plasticized caking substance is spread on the surface of coal granules in the low speed rotating type mixer, and the heated mixture is briquetted by using a roll press. In comparison, in the present invention, the caking substance having a softening point of 20°–40° C is, if necessary, warmed so that it has the suitable plasticity for the easy handling in operation. The caking substance and coal granules are mixed intensively and sufficiently uniformly by the application of strong mechanical force within a short time, which causes the caking substance to extend on the surface of the coal granules and to coat them, whereby no heating medium is required during the mixing and briquetting steps.

When using a caking substance having a softening point of above 40° C, a solvent which has the fluidity at normal temperature and is compatible with the caking substance is blended additionally while mixing the caking substance granules and the coal granules intensively and sufficiently uniformly by the application of strong mechanical force. Under the influence of the solvent, the caking substance having a softening point of above normal temperature is dissolved on the surface of coal granules to extend thereon and to coat the coal granules. Thus the surface of coal granules can be coated sufficiently uniformly with the caking substance by the synergistic effect of the strong mechanical force and the solvent, even if the mixing is performed at a very low temperature compared with the softening point of the caking substance. Therefore, according to the present invention in both cases where a caking substance having a softening point of 20°–40° C and a caking substance having a softening point of above 40° C are used, a heating medium such as steam is not required during the mixing and briquetting steps.

In the present invention, a caking substance having a softening point of 20°–40° C, for example road tar, asphalt or a caking substance mixture which is obtained by blending a caking substance having a softening point of above normal temperature with such as coal tar to adjust the softening point within the above range, can be used. As examples of caking substance having a softening point of above 40° C, coal tar pitch or a high aromatic pitch fraction having a hydrogen/carbon atom ratio of less than 1.0 which is separated from asphalt or crude oil such as petroleum base residual oil by contacting with a heating medium for a short time, and a pitch fraction obtained by the heat treatment or solvent extraction of, for example, coal tar pitch, petroleum pitch or asphalt, can be used. The blending ratio of caking substance may be selected from the range of 4–15% by weight, regarded as suitable for the preparation of such briquettes, taking consideration into the strength of briquettes, briquettability and other factors. A solvent compatible with the caking substance which has a softening point of above 40° C, for example coal tar or propane deasphalting asphalt, can be used. The blending ratio of solvent may be selected optionally from the range of 3–15% by weight, regarded as suitable for the preparation of such briquettes, taking consideration into the briquettability of briquettes.

In performing the present invention a high speed rotating type mixer and/or an increasing pressure type mixer, is used instead of a low speed rotating type mixer heretofore used. Among apparatuses of these types, a high speed rotating type mixer includes an Eirich type mixer wherein a pan to be charged with raw material and an auxiliary mixing tool which is disposed in the pan eccentrically to the center thereof are rotated in the opposite direction each other, and further a main mixing tool, a high speed aggitator disposed in the pan is rotated at a high speed, thereby a strong impact force is applied between the granules or between the granules and the mixing tools, thereby the mixing can be performed at a relative velocity between the granules to be mixed themselves or at a peripheral velocity between the granule to be mixed and the mixing tools of more than 5m/sec., in energy requirements (energy applied per unit weight of material to be mixed in mixing) of about 0.05–0.4kW/kg. An increasing pressure type mixer includes a Muller type mixer wherein the loading is effected by adjusting the weight of a revolving muller wheel, for example, by means of a spring, the loading in compression can be selected optionally within a certain range, for example, from 10–22kg to 2260–3500kg depending upon the kind of the apparatus, and the granules to be mixed are subjected to three functions; kneading, smearing and spatulate and mixed as the muller wheel is applying pressure to them, resulting in energy requirements of about 0.02–0.13kW/kg.

As a coal to be used for making briquettes in the present invention, hard coking coal, semi hard coking coal, soft coking coal poorly coking coal and non coking coal are used alone or in combination in an optional blending ratio. These coals are preferably selected such that the drum strength of more than $DI_{15}^{30}$ 92 is obtained, with respect to a coke which is obtained by blending the briquettes prepared according to the present invention to a coal ready for coke oven charging and then carbonizing at a high temperature, or with respect to a formed coke which is carbonized directly the briquettes prepared from coal for making formed coke.

The present invention will be explained refering to the following Examples:

EXAMPLE 1

To a coal ready for coke oven charging which is blended in the ratio of 24% hard coking coal, 58% semi hard coking coal and 18% soft coking coal is added 6% in rounded number, based on the coal, of a caking substance having a different softening point shown in Table 1, and then the blend is charged into an Eirich type mixer. In the case where the caking substance has a softening point of above 40° C, 3% in rounded number of coal tar heated to 50° C as a solvent is added. In each case, immediately after mixing for 3 minutes, Mashek type briquettes (32mm × 32mm × 18mm) are prepared by using a roll press. The briquettes obtained are examined on the shutter strength according to ASTM D141 Falling Strength Test and the trommel strength according to JNR Trommel Test. The results obtained are shown in Table 1. The coals have a grading of 84% under 3mm square screen and a total content of 8%. The softening point is determined by the ring and ball method (JIS K 2531 Petroleum Asphalt Softening Point Test Method).

Table 1

| Test No. | 1 | 2 | 3 | 4 | 5 | 6 | 7 |
|---|---|---|---|---|---|---|---|
| Softening point of caking substance (° C) | 15 | 22 | 31 | 40 | 63 | 80 | 121 |
| Amount of tar added (%) | 0 | 0 | 0 | 0 | 3 | 3 | 3 |
| Shutter strength | 54.8 | 79.8 | 84.4 | 83.1 | 95.3 | 94.7 | 93.0 |
| Trommel strength | 81.4 | 90.5 | 92.6 | 92.5 | 94.3 | 93.6 | 93.1 |

From the results shown in Table 1, it is shown that in Test No. 1 where a caking substance having a softening point of 15° C is used low shutter strength as well as trommel strength are obtained and the product therefore has poor utility. On the other hand, when using caking substances having a softening point of 20°–40° C, briquettes which can be used satisfactorily on industrial scale are obtained. Moreover, even when caking substances having a softening point of above 40° C are used, briquettes of similarly good quality can be prepared without heating during the mixing and briquetting steps by using a solvent such as coal tar in conjunction with the caking substance. That is to say, briquettes having a shutter strength of more than 80 and a trommel strength of more than 90 can be used satisfactorily in operating usual coke production, if given proper care to the transportation, storage and others in the preparation of briquettes on industrial scale.

EXAMPLE 2

85 parts of a coal ready for coke oven charging which is blended in the ratio of 31% hard coking coal, 45% semi hard coking coal and 24% soft coking coal, 8 parts of petroleum pitch having a softening point of 196° C obtained by heat treatment of asphalt and 7 parts of coal tar heated to 50° C are charged into a Muller type mixer which is adjustable to a pressure in a range of 30–100kg/cm$^2$ mixed in an energy requirement of 0.03–0.04kW/kg for 3 minutes, and immediately thereupon briquetted by using a roll press to prepare briquettes similar to those of Example 1. The briquettes obtained are examined according to the methods in Example 1. The result obtained are shown in Table 2. The coals have the grading of 84% under 3mm square screen and the temperature in briquetting agrees with the mixing temperature within ±3° C, respectively.

Table 2

| Test No. | 8 | 9 | 10 | 11 | 12 | 13 |
|---|---|---|---|---|---|---|
| Total moisture (%) | 8 | 8 | 8 | 11 | 11 | 11 |
| Mixing temp. (° C) | 10–13 | 22–25 | 38–41 | 10–12 | 22–25 | 38–40 |
| Shutter strength | 81.2 | 92.7 | 92.7 | 87.5 | 89.5 | 84.6 |
| Trommel strength | 90.2 | 96.0 | 96.4 | 97.0 | 97.5 | 97.5 |

From the results shown in Table 2, it is shown that when using petroleum pitch having a softening point of 196° C, satisfactory briquettes are also obtained by mixing at about 10°–40° C, namely normal temperature owing to the combination with a suitable solvent.

EXAMPLE 3

A briquetting blend which is blended in the ratio of 60% coal ready for coke oven charging described in Example 2 and 40% of poorly coking coal and non coking coal, is charged into an Eirich type mixer whose main mixing tool is rotated at a peripheral velocity of 10m/sec. and whose auxiliary mixing tool is rotated at a peripheral velocity of 2m/sec., and mixed in an energy requirement of 0.16–0.18kW/kg for a varied time, and immediately thereupon briquetted by using a roll press to prepare briquettes similar to those of Example 1 and which are then examined according to the methods in Example 1. The results obtained are shown in Table 3. The total moisture content of the coals is 8%, and the temperature before mixing is 28° C.

Table 3

| Test No. | 14 | 15 | 16 | 17 |
|---|---|---|---|---|
| Mixing time (minute) | 0.5 | 1.0 | 1.5 | 3.0 |
| Temp. after mixing (° C) | 34 | 37 | 39 | 47 |
| Shutter strength | 72.6 | 90.8 | 94.6 | 96.5 |
| Trommel strength | 89.2 | 92.5 | 93.7 | 93.8 |

From the results shown in Table 3, it is clear that when using petroleum pitch having a softening point of 196° C, briquettes which also have applicable strength similar to those of Example 2, are obtained without special heating if mixing is performed by using the Eirich type mixer whose mixing tool is rotated at a peripheral velocity of 10m/sec.

Example 2 and Example 3 illustrate the cases where the Muller type mixer and the Eirich type mixer are used alone, however it is possible to use both mixers at the same time or a mixer combined both types and then the better results are obtainable depending on the some conditions.

EXAMPLE 4

A mixture consisting of 87 parts of a coal for making briquettes which is blended in the ratio of 38% soft coking coal and 62% of poorly coking coal and non coking coal and ground to the grading of 82% under 3mm square screen, 8 parts of a petroleum pitch having a softening point of 162° C which is obtained by heat treating asphalt, and 5 parts of coal tar heated to 50° C is charged into a Muller type mixer, Eirich type mixer and Pug mill (low speed rotating type mixer), respectively, for the purpose of clarifying the effect of the present invention. Immediately after mixing, the mixture is briquetted by using a roll press to prepare briquettes similar to those of Example 1 which are then examined according to the methods of Example 1. The results obtained are shown Table 4. Total moisture of the coal is 8%, and the temperature before mixing is 29° C.

Table 4

| Test No. | 18 | 19 | 20 | 21 | 22 | 23 | 24 | 25 | 26 | 27 |
|---|---|---|---|---|---|---|---|---|---|---|
| Muller type mixer | 0 | 0 | 0 | | | | | | | |
| Eirich type mixer | | | | 0 | 0 | 0 | | | | |
| Pug mill | | | | | | | 0 | 0 | 0 | 0 |
| Mixing time (minute) | 1 | 2 | 5 | 1 | 2 | 3 | 1 | 3 | 5 | 10 |
| Temp. after mixing (° C) | 32 | 34 | 33 | 33 | 39 | 48 | 29 | 29 | 30 | 32 |
| Shutter strength | 81.8 | 91.7 | 92.8 | 82.5 | 91.8 | 95.0 | 13.2 | 21.4 | 39.0 | 57.0 |
| Trommel strength | 90.2 | 92.4 | 95.4 | 91.8 | 95.2 | 93.8 | 38.0 | 54.2 | 81.0 | 90.1 |
| Note | According to the present invention. | | | | | | Comparative example. | | | |

From the results shown Table 4, it is shown that when using conventional pug mill, briquettes having applicable strength cannot be obtained by performing the mixing and briquetting steps at normal temperature, even after a considerably long period of time in mixing. It stands to reason that such a result was obtained this time, since such a low speed rotating type mixer usually be provided means for passing through steam of high temperature. Both the Muller type mixer and Eirich type mixer used in accordance with the present invention cause the product to raise in strength as mixing progresses, and the the briquettes usuable in practice are obtained in a short mixing time, respectively. Meanwhile, when a portion the mixture after blending, which is shown in Table 4, Test No. 26 is mixed by using pug mill under passing steam of 150° C for 5 minutes and then briquetted, briquettes having shutter strength of 90.1 and trommel strength of 94.5 are obtained, that is to say these briquettes can be used in practice. However, in case where steam is not blasted, such as in Test No. 27, no briquettes of applicable strength can be obtained if only the mixing time is prolonged, and even if a solvent is combined. Consequently it is proved that in a low speed rotating type mixer hitherto used, a heating medium such as steam is required during mixing to yield acceptable briquettes.

EXAMPLE 5

85 parts of a coal ready for coke oven charging which is blended in the ratio of 40% hard coking coal, 32% semi hard coking coal and 28% soft coking coal, 8 parts of petroleum pitch having a softening point of 180° C which is obtained by heat treatment of asphalt, and 7 parts of coal tar heated to 50° C are charged into a Muller type mixer and a Eirich type mixer, and immediately after mixing, briquetted by using a roll press to prepare to briquettes similar to those of Example 1 which are then examined according to the methods in Example 1. This Example is intended to test the variables of applied pressure and the relative speed of mixing tool to granules to be mixed. Therefore, in the Muller type mixer, the applied pressure is varied as shown in Table 5 by adjusting the spring of muller wheel, while in the Eirich type mixer, the relative speed of mixing tool to granules to be mixed is varied as shown in Table 6 by adjusting the rotating speed of mixing tool. The results obtained and mixing time are shown in Table 5 and Table 6. The coal has the grading of 84% under 3mm square screen and the total moisture content of 8%.

Table 5

| Test No. | 28 | 29 | 30 | 31 |
|---|---|---|---|---|
| Applied pressure (kg/cm$^2$) | 35 | 45 | 60 | 100 |
| Mixing time (minute) | 4 | 4 | 4 | 4 |
| Shutter strength | 75.3 | 90.4 | 92.5 | 92.0 |
| Trommel strength | 87.9 | 91.1 | 91.5 | 93.2 |

Table 6

| Test No. | 32 | 33 | 34 | 35 |
|---|---|---|---|---|
| Relative speed (m/sec.) | 2.5 | 5 | 10 | 20 |
| Mixing time (minute) | 3 | 3 | 3 | 3 |
| Shutter strength | 71.3 | 90.8 | 95.6 | 95.3 |
| Trommel strength | 70.1 | 90.1 | 93.4 | 93.8 |

The results shown in Table 5 and Table 6, indicate that briquettes applicable satisfactorily can be obtained both in using a Muller type mixer at having a muller wheel pressure of more than 45Kg/cm$^2$ and in using an Eirich type mixer having a mixing tool peripheral velocity of more than 5m/sec.

Thus, according to the present invention, in preparing by blending a caking substance to a coal to be used for making briquettes metallurgical briquettes, briquettes satisfactorily in practice can be prepared on industrial scale without heating in the mixing and briquetting steps mainly by selecting suitable mixing conditions. In addition when using a caking substance having a softening point of above normal temperature in combination with a solvent which has fluidity at normal temperature and is compatible with said caking substance, the range restricted by the softening point of caking substance to be used can be remarkably widened. Moreover, since steam is not used, the present invention provides a number of advantages such as the simplification of facilities, the improvement of working atmosphere, the easy administration of working, etc.

What is claimed is:

1. A process for preparing a briquette comprising the steps of blending a caking substance having a softening point of above 20° C to a coal to be used for making briquettes to yield a blend, mixing the blend at a temperature of above 10° C for 1–10 minutes with a mixer capable of applying mixing energy of more than 0.02KW/kg and briquetting at a normal temperature by using a roll press.

2. The process as claimed in claim 1 wherein said softening point of the caking substance is 20°–40° C.

3. The process as claimed in claim 1 wherein the caking substance has a softening point of above 40° C and a solvent which has fluidity at normal temperature and is compatible with said caking substance is further blended to the coal to be used for making briquettes.

4. The process as claimed in claim 1 wherein a mixing tool of said mixer is rotated at a high speed of more than 5m/sec. peripheral velocity in an energy requirement of 0.05–0.4kW/kg, thereby giving a strong impact force.

5. The process as claimed in claim 1 wherein a mixing tool of said mixer is operated at a pressure of more than 45kg/cm$^2$ in an energy requirement of 0.02–0.13kW/kg, thereby caused kneading, smearing and spaturate.

6. The process as claimed in claim 1 wherein said mixing time is 2–5 minutes.

7. The process as claimed in claim 1 wherein said mixing temperature is above 20° C.

8. The process as claimed in claim 1 wherein a temperature is maintained at 10°–50° C in said mixing and briquetting steps.

9. The process as claimed in claim 1 wherein a blending ratio of said caking bustance is selected from a range of 4–15% by weight.

10. The process as claimed in claim 3 wherein a blending ratio of said solvent is selected from a range of 3–15% by weight.

11. A process for preparing a briquette comprising the steps of blending a caking substance having a softening point of 20°–40° C to a coal to be used for making briquettes to yield a blend, mixing the blend at a temperature of above 10° C for 1–10 minutes by using a powerful mixer whose mixing tool is rotated at a speed of more than 5m/sec. peripheral velocity to said blend and a mixer whose mixing tool applies a pressure of more than 45kg/cm$^2$ to said blend, and briquetting by using a roll press.

12. A process for preparing a briquette comprising the steps of blending a caking substance having a softening point of above 40° C and a solvent which has the fluidity at normal temperature and is compatible with said caking substance to a coal to be used for making briquettes to yield a blend, mixing the blend at a temperature of above 10° C for 1–10 minutes by using a mixer whose mixing tool is rotated at a speed of more than 5m/sec. peripheral velocity to said blend and a mixer whose mixing tools applies a pressure of more than 45kg/cm$^2$ to said blend, and briquetting by using a roll press.

* * * * *

UNITED STATES PATENT OFFICE
CERTIFICATE OF CORRECTION

PATENT NO. : 4,073,625

DATED : February 14, 1978

INVENTOR(S) : Yoshio Kiritani et al

It is certified that error appears in the above-identified patent and that said Letters Patent are hereby corrected as shown below:

[30] Foreign Application Priority Data

November 17, 1975 Japan..... 50-137567

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*